US006618874B2

(12) United States Patent
Gerloff

(10) Patent No.: US 6,618,874 B2
(45) Date of Patent: Sep. 16, 2003

(54) WASTE FOR A WASHBASIN OF A WASHSTAND WITH A SLOT-SHAPED RUNOUT

(76) Inventor: Michael Gerloff, Schwarzer Weg 4, Eschwege (DE), D-37269

( * ) Notice: Subject to any disclaimer, the term of this patent is extended or adjusted under 35 U.S.C. 154(b) by 0 days.

(21) Appl. No.: 09/949,530

(22) Filed: Sep. 10, 2001

(65) Prior Publication Data

US 2003/0046758 A1 Mar. 13, 2003

(51) Int. Cl.[7] ..... E03C 1/114
(52) U.S. Cl. ..... 4/650; 4/619
(58) Field of Search ..... 4/613, 650–653, 4/679

(56) References Cited

U.S. PATENT DOCUMENTS 4,777,676 A * 10/1988 Ericson ..... 4/619

5,911,518 A * 6/1999 Jurek et al. ..... 4/613 X

* cited by examiner

*Primary Examiner*—Charles E. Phillips
(74) *Attorney, Agent, or Firm*—Thomas R. Vigil; Welsh & Katz, Ltd.

(57) ABSTRACT

The subject matter of the invention is first a waste (10) for a washbasin (3) of a washstand (1) with a slot-shaped runout (6) with a channel-shaped trough (20) with a connecting branch (21) for connection to a drain pipe and second a washstand (1), wherein the basin (3) is formed by a rear wall (5) oriented approximately normal to the upper side of the washstand (1) and by a bottom (4) that extends angularly from the upper side and is oriented toward the rear wall (5), a slot-shaped runout (6) being formed between rear wall (5) and bottom (4) , and wherein the slot-shaped runout (6) is provided with a channel-shaped trough (20) according to one or several features of the claims 1 through 9.

8 Claims, 5 Drawing Sheets

WASTE FOR A WASHBASIN OF A WASHSTAND WITH A SLOT-SHAPED RUNOUT

BACKGROUND OF THE INVENTION

1. Field of the Invention

The present invention relates to a waste for a washbasin of a washstand with a slot-shaped runout.

2. Description of the Prior Art

Washstands are characterized by a more or less level upper side in which the washbasin, serving to receive the water, is embedded.

Customary washstands are known. These are made of earthenware or porcelain and are provided with a round connecting branch in the region of the curved basin. The waste pipe with the trap is connected to said connecting branch.

In recent times, washstands have increasingly been manufactured from natural stone. It is of course possible to produce washstands with curved basins out of natural stone in which the actual basin is provided with a round connecting branch. However, the manufacturing of such washstands is very expensive since at least the actual basin must be manufactured from the full stone. Accordingly, there is a need for washstands made from natural stone that can be manufactured at low cost. Such low cost washstands of natural stone are characterized in that the actual basin is provided with a bottom that extends from the upper side of the washstand and that runs slantways, a rear wall oriented vertically from the upper side of the washstand toward the slant bottom being offset to the rear relative to the front edge of the bottom and a longitudinally oriented slot being provided between the rear wall and the bottom for the water to run out. Corresponding side walls are provided on the respective sides between the upper side and the slantways oriented bottom or the rear wall.

Such a washbasin has a very modern Bauhaus design. The problem therewith is to drain the water from the slot-shaped runout, though. This is due to the fact that the waste pipe is round and that there has to be created a transition from an angular or slot-shaped runout to a round one. In a first approach it was thought to place a corresponding round connecting branch in the region of the lower end of the basin, but this cannot be allowed because of the tightness problems that are to be expected on account of the many edges.

It is therefore the object of the invention to provide a waste for a washbasin with a slot-shaped runout that is easily installed, that does not create any problems of tightness in the region of transition from the slot-shaped runout to the round waste pipe and that may moreover be manufactured at low cost.

SUMMARY OF THE INVENTION

According to the invention, the solution of this object is achieved by providing the slot-shaped runout with a channel-shaped trough with a connecting branch for connection to a drain pipe.

Such a channel-shaped trough may be made from steel sheet or from synthetic material and permits on one side to optimally conform to the walls of the washbasin in the region of the slot-shaped runout and on the other to be directly connected to the respective trap or the waste pipe when the runout is realized as a round connecting branch.

According to a particularly advantageous feature there is provided that the channel-shaped trough has a ring that is realized to conform to the contour of the channel-shaped trough and that can be inserted in said trough. Such a ring, which constitutes an encircling closed formation, may optimally conform to the contour of the basin. To have the contour of the trough conform to the basin in the region of the slot-shaped runout would involve greater problems in manufacturing engineering since the trough is provided with the bottom that is fitted with the connecting branch.

It also proved particularly advantageous to devise the trough in such a manner that it may be removably connected to the ring. The reason therefor is that in such a case the trough may be removed for purposes of inspection of the waste pipe.

This clearly shows that in this advantageous construction the ring is firmly attached to the basin in the region of its upper edge and removably receives the trough at its lower side.

There is more specifically provided that the side walls of the trough conically widen in outward direction, the ring showing side walls that are tapering in the opposite direction so that the ring may be inserted into the trough. In the region of the walls a seal is provided between trough and ring to prevent the column of water that builds up in case of a—for whatever reason—clogged waste pipe from flowing out.

According to another feature of the invention, there is provided, in order to still be capable of fastening the ring to the basin that the ring be provided on its upper edge turned away from the trough with an encircling collar that is to rest on the basin in the region of the slot-shaped runout. The collar hereby constitutes the bearing surface for receiving e.g., silicon in order to provide a watertight bond between the collar and the basin. In this respect there is provided that the collar be oriented vertically in the region of the one longitudinal edge to come to rest on the rear wall of the basin and be oriented at an angle to the vertical in the region of the other longitudinal edge, i.e., of the underside of the bottom, in order to allow the collar to rest plainly on the basin. On account of the design of the washbasin, the collar is in this regard devised to be higher at the one rear longitudinal edge than at the other longitudinal edge situated at the front in the region of the slot-shaped runout. In order to facilitate the removal of the trough from the ring, quick-acting bent-lever closures are provided for at the respective small faces of the trough or of the ring.

Another subject matter of the invention is a washstand, the basin of the washstand being formed by a rear wall oriented approximately normal to the upper side of the basin and by a bottom that extends angularly from the upper side and is oriented toward the rear wall, a slot-shaped runout being provided between rear wall and bottom, such a washbasin being characterized in that the slot-shaped runout is provided with a channel-shaped trough according to one or several features of the claims 1 through 9.

BRIEF DESCRIPTION OF THE DRAWING(S)

The invention will be explained more explicitly hereinafter with regard to the drawing.

DESCRIPTION OF THE PREFERRED EMBODIMENT(S)

Figure 1:
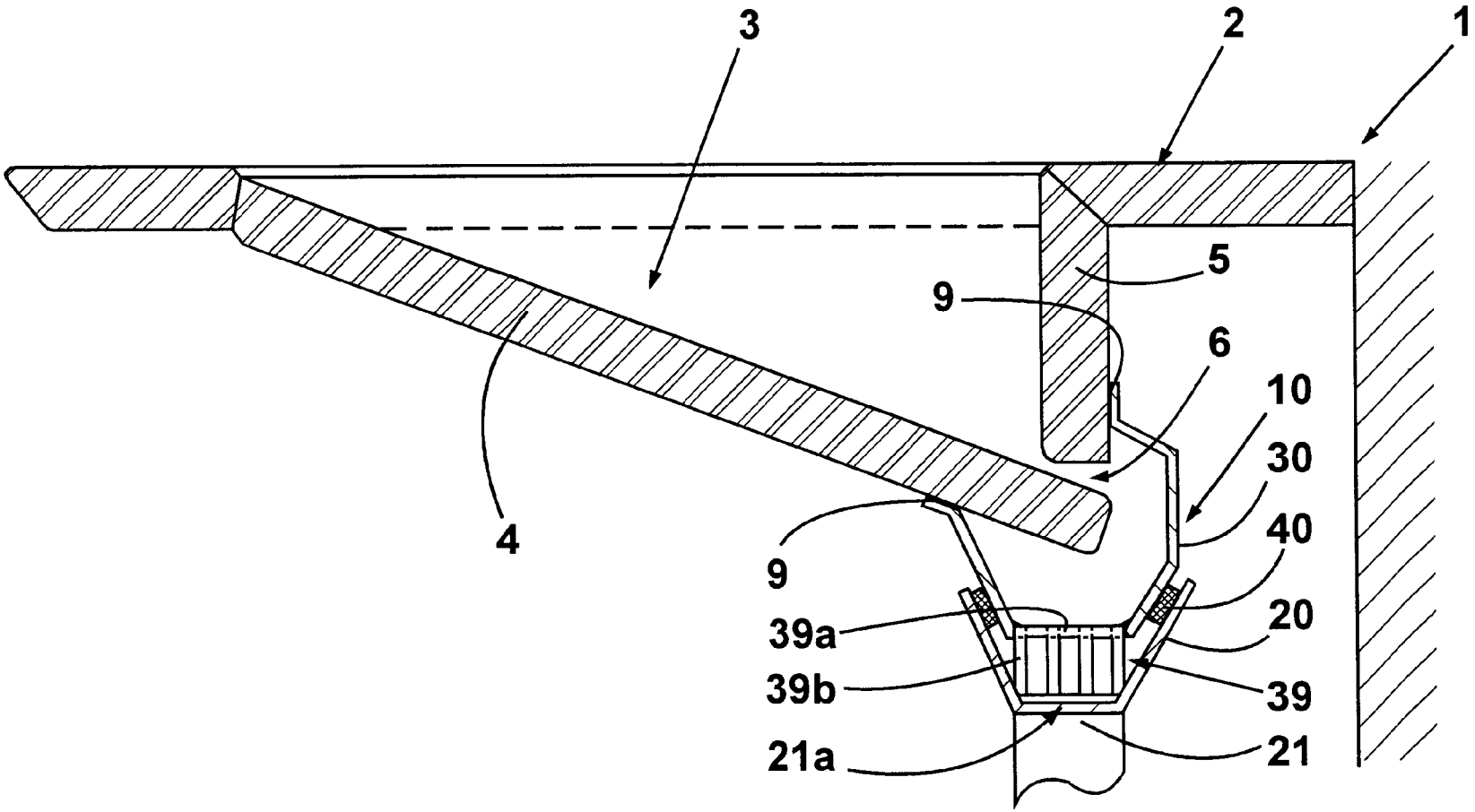
FIG. 1 is a sectional view of the design of the washstand with washbasin with the channel-shaped trough.

According to FIG. 1, the washstand indicated at 1 shows an upper side 2 in which the washbasin 3 is embedded. The basin 3 is formed by a bottom 4 extending slantways from the upper side 2 and by a rear wall 5 extending normal to the upper side 2, the slot-shaped runout 6 being provided between rear wall 5 and bottom. Side walls (not shown) limit the basin 3 at its sides and join the upper side, the rear wall and the bottom.

The waste 10 is arranged in the region of the runout 6 of the washbasin 3. The waste 10 consists of the channel-shaped trough 20 with the connecting branch 21 and with the encircling ring indicated generally at 30. A seal 40 is accommodated between the ring 30 and the trough 20 in the region of the side walls.

Figure 2:
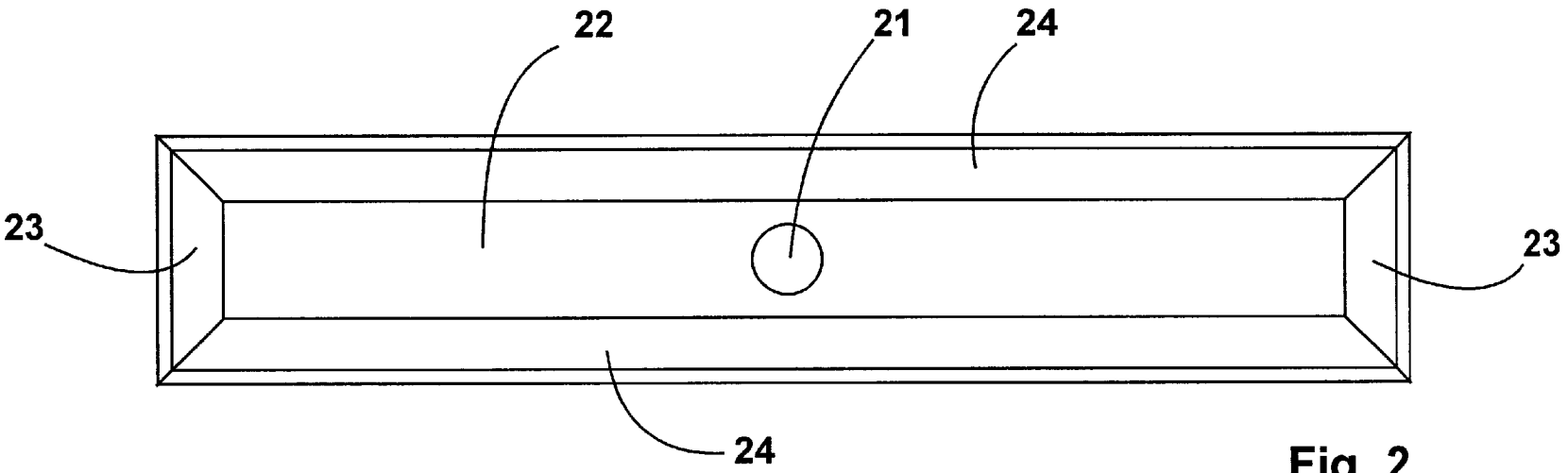
FIG. 2 is a top view of the channel-shaped trough.
Figure 3:
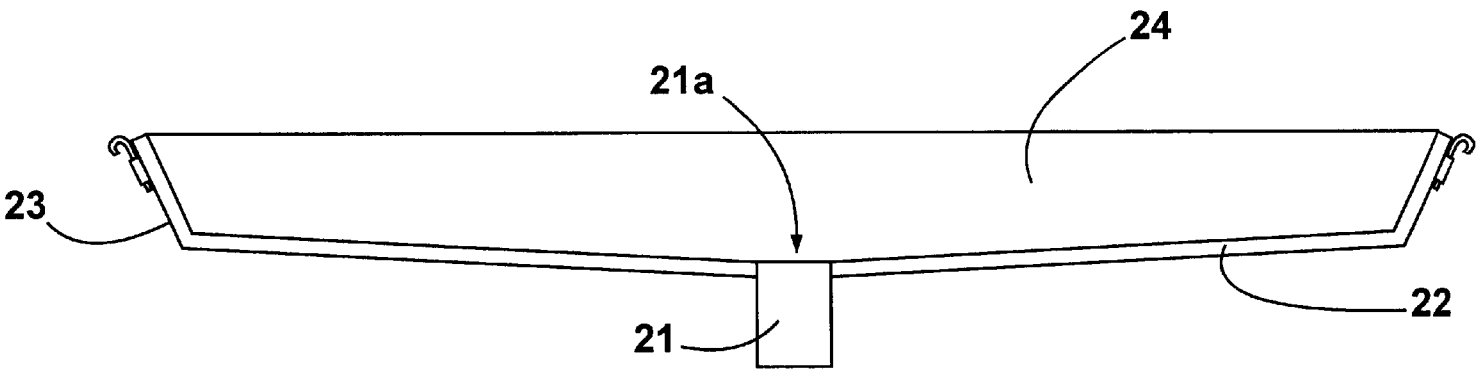
FIG. 3 is a side view of the channel-shaped trough.
Figure 4:
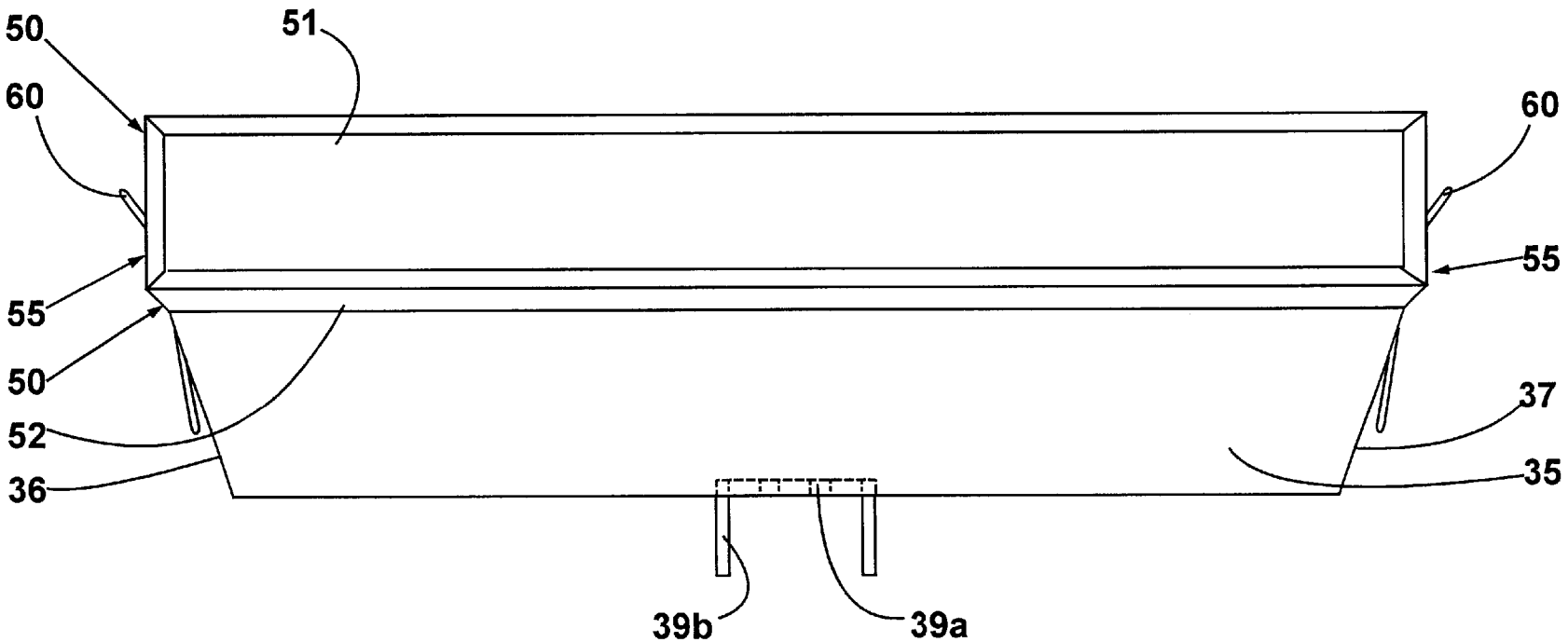
FIG. 4 is a side view of the ring.
Figure 5:
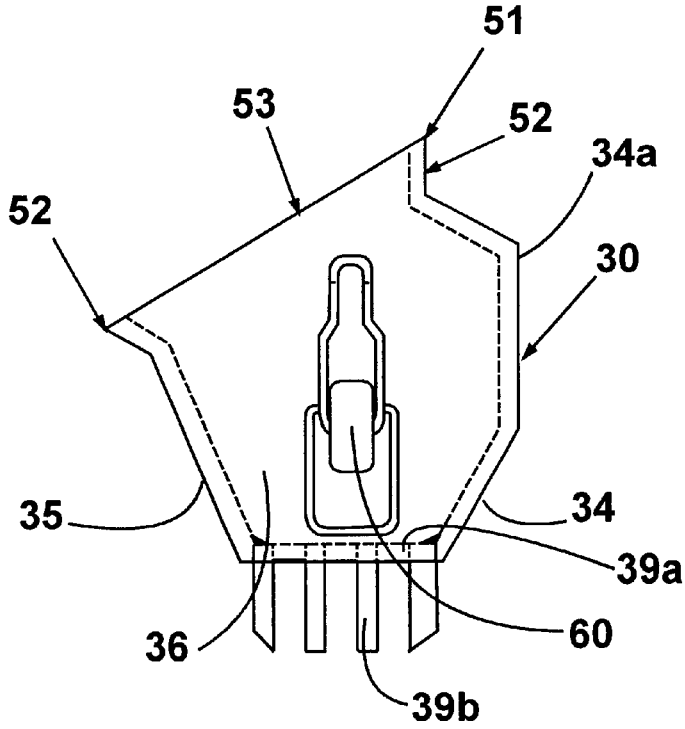
FIG. 5 is another side view of the ring.

The design of the channel-shaped trough 2 is shown more specifically in the FIGS. 2 and 3. There, it can be surveyed that the channel-shaped trough 20 has a bottom 22 provided with a gradient at the deepest point of which there is arranged the connecting branch 21 with the waste orifice 21*a* for the waste pipe. Side walls 23 and 24 that are widening conically outward respectively abut the bottom 22 contouring it. In accordance with the design of the walls 23, 24, the ring which is generally indicated at 30 is fitted with respective side walls 34, 35 and 36, 37 that are tapered in opposite direction for its reception by the channel-shaped trough 20. Between said walls 23, 24 of the channel-shaped trough 20 and the walls 34 through 37 of the ring 30 there is located the seal 40 already described herein above. A rear wall 34*a* abuts the side wall 23 and is oriented toward the rear wall 5 of the basin 3. The ring 30 is moreover fitted with an encircling collar 50, said collar 50 being oriented approximately vertically in the region of the one longitudinal edge 51 so that said collar is oriented approximately parallel to the rear wall of the basin 3. In this region, the collar 50 abuts the rear wall 34*a*. In the region of the other longitudinal edge located at the front 52, the collar 50 is configured in a similar way inasmuch as the collar has an angular design corresponding to the orientation of the bottom 4 of the washbasin so that in this region the collar extends parallel to the underside of the bottom 4. The connection between collar and basin is carried out by a glued joint 9 e.g., by means of silicon. In the region of the small face 53, the collar is formed by the side wall 55 of the ring.

Figure 6:
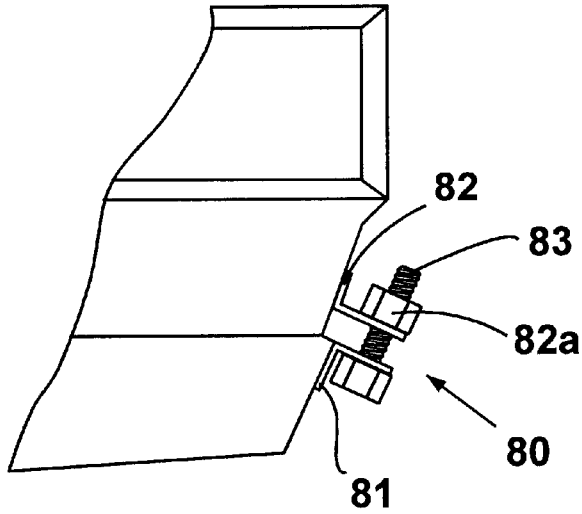
FIG. 6 is a cutout showing the alternative screw connection between trough and ring.
Figure 7:
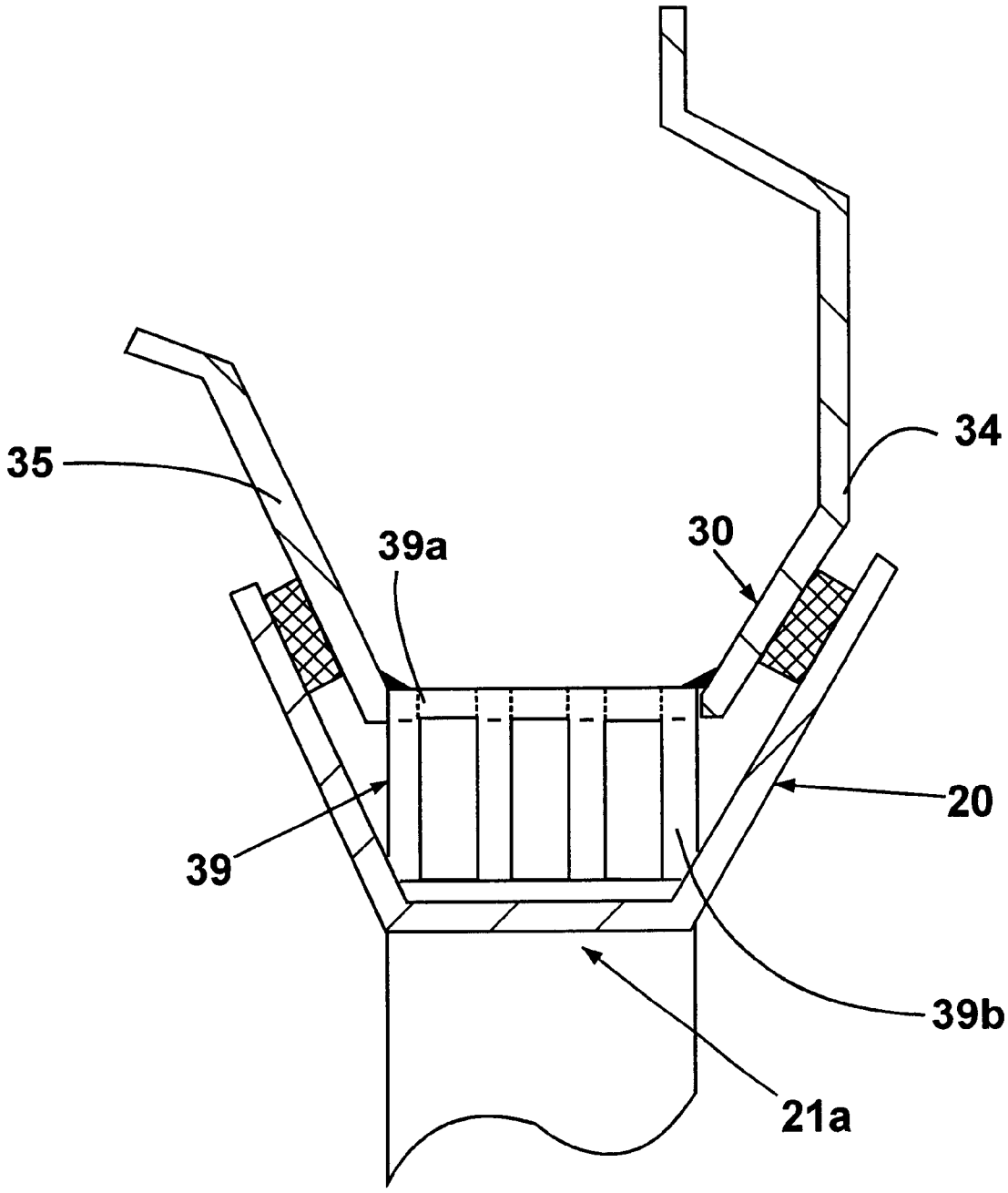
FIG. 7 shows the arrangement of the cage with the perforated plate on the waste of the trough.

To connect the ring 30 to the trough 20, so-called quick-acting bent-lever closures 60 are provided. Said quick-acting bent-lever closures 60 are configured to be springy in order to be capable of pulling the trough 20 against the seal 40 between ring and trough. According to FIG. 6, a screw connection 80 between trough 20 and ring 30 is also conceivable, though. The screw connection is composed of brackets 81, 82 that are arranged on the respective front sides of the ring and the trough and that can be joined together by the screw 83, the one bracket 82 being provided with a threaded nut 82*a* for the screw. The waste can be inspected in any case and more specifically when the waste pipe is clogged by detaching the trough 20 from the ring 30.

In the ring 30 there is placed an insert 39 above the connecting branch 21, said insert being provided with a cage 39*b* that is constituted of discrete rods and has an upper perforated plate 39*a* for preventing objects that have fallen into the washbasin from being flushed through the waste orifice 21*a*. Said insert 39 moreover also stiffens the ring 30, guarding it from bending on account of the transverse bracing of the side walls. This serves to improve sealing since, as a result thereof, the side walls 35, 39 cannot bend inward, i.e. toward each other. This means that it is guaranteed that the side walls 23 of the trough 20 abut the side walls 35 of the ring 30 via the seal 40.

I claim:

1. A waste (10) for a washbasin (3) of a washstand (1) with a slot-shaped runout (6), the runout having a channel-shaped trough (20) with a connecting branch (21) for connection to a drain pipe characterized in that the channel-shaped trough (2) has a ring (30) that is configured to conform to the countour of the trough (2) is insertable in, and detachably connectable with, said trough (20) and is located adjacent to the slot-shaped runout (6).

2. The waste of claim 1, characterized in that side walls (23, 24) of the trough (20) widen conically in an outward direction and the ring (3) has side walls (34–37) that taper in the opposite direction so that the ring (3) may be inserted into the trough (20).

3. The waste of claim 1, characterized in that the ring (30) is provided on an upper edge that is turned away from the trough (2) with an encircling collar (5) that is to rest on the basin (3) in the region of the slot-shaped runout (6) of the washbasin (1).

4. The waste of claim 3, characterized in that the collar (50) is oriented vertically in the region of a longitudinal edge (51) and is oriented at an angle to the vertical in the region of another longitudinal edge (52).

5. The waste of claim 3, characterized in that the collar (5) is oriented at a higher level at a rear longitudinal edge (51) than at another longitudinal edge situated at a front (52).

6. The waste of claim 1, characterized in that the trough (20) is removably arranged on the ring (30), which is attached to the washbasin (3), by means of quick-acting bent-lever closures (60).

7. The waste of claim 1, characterized in that a seal (4) is provided between the ring (3) and the trough (2).

8. Washstand (1), wherein the basin (3) is formed by a rear wall (5) oriented approximately normal to the upper side of the washstand 91) and by a bottom (4) that extends angularly from the upper side and is oriented toward the rear wall (5), a slot-shaped runout (6) being formed between the rear wall (5) and the bottom (4), characterized in that the slot-shaped runout (6) is provided with a channel-shaped trough (2) and a ring is detachably connected to said channel-shaped trough.

* * * * *